United States Patent [19]

Ryncosky et al.

[11] 4,032,253

[45] June 28, 1977

[54] COMPENSATING RING FOR A ROTARY MACHINE

[75] Inventors: Robert G. Ryncosky, Jeannette; Alexander A. Carroll, Greensburg, both of Pa.

[73] Assignee: Carrier Corporation, Syracuse, N.Y.

[22] Filed: Sept. 11, 1975

[21] Appl. No.: 612,392

[52] U.S. Cl. ..... 415/136; 415/139; 415/219 R

[51] Int. Cl.[2] ..... F01D 25/26

[58] Field of Search ..... 415/108, 135, 136, 137, 415/138, 139, 219 R

[56] References Cited

UNITED STATES PATENTS

| | | | |
|---|---|---|---|
| 2,220,616 | 11/1940 | Roder | 415/138 |

FOREIGN PATENTS OR APPLICATIONS

| | | | |
|---|---|---|---|
| 554,367 | 7/1932 | Germany | 415/136 |
| 110,556 | 9/1924 | Switzerland | 415/135 |
| 219,023 | 10/1925 | United Kingdom | 415/136 |
| 221,632 | 9/1924 | United Kingdom | 415/138 |
| 228,576 | 4/1925 | United Kingdom | 415/136 |
| 243,974 | 12/1925 | United Kingdom | 415/138 |
| 345,888 | 4/1931 | United Kingdom | 415/136 |

*Primary Examiner*—Henry F. Raduazo
*Attorney, Agent, or Firm*—J. Raymond Curtin; Donald F. Daley

[57] ABSTRACT

A member interposed between the inner and outer casings of a rotary machine which is arranged to hold the casings in concentric alignment with the machine shaft as the two casings undergo transient thermal and pressure growth.

2 Claims, 2 Drawing Figures

COMPENSATING RING FOR A ROTARY MACHINE

BACKGROUND OF THE INVENTION

This invention relates to rotary machinery and, in particular, to apparatus for use in a rotary machine having an inner and outer casing which maintains the inner casing centered in respect to the machine shaft as the casings grow under differential thermal and/or pressure loading.

It has been found advantageous in rotary machines, such as turbines and compressors experiencing high internal pressures and temperatures, to provide the machine with both an inner casing and an outer casing. In assembly, the stationary components of the machine are generally suspended from the inner casing and the casing axially aligned with the rotor structure supporting the movable machine components. A heavier outer casing, in turn, is placed over the inner casing so that an annular space is provided therebetween. Under operating conditions, the space between the two casings is pressurized. In the case of a compressor, the space between the casings is normally pressurized to the machine discharge pressure by simply bleeding discharge fluids into this area. The casing are arranged so that the inner casing is firmly fitted within the outer casing.

When operating at high pressures and high transient temperatures, the outer casing of the machine grows at a different rate than the inner casing whereby the outer casing normally tends to move away from the inner casing. Because the rotor shaft generally extends axially through the machine, the two casings cannot be mutually supported about their commonly shared axis to maintain coaxial alignment during periods of growth. As can be seen, uncontrolled growth of the two casings can lead to misalignment of the machine components and ultimately to machine failure.

SUMMARY OF THE INVENTION

It is therefore an object of the present invention to improve rotary machines utilizing an inner and outer casing construction.

A further object of the present invention is to maintain the components of a rotary machine having both an inner and outer casing in alignment as the casings grow under high internal pressures and temperatures.

A still further object of the present invention is to provide means for centering the inner casing of a rotary machine in alignment with the machine shaft while simultaneously allowing the outer casing to grow away from the inner casing.

These and other objects of the present invention are attained in a rotary machine having an outer casing encompassing an inner casing to provide an annular space therebetween including an annular member interposed between the two casings which acts as a beam mounted upon an elastic foundation, the annular member being fitted within the outer casing by preshrinking the member in compression so that it seats against the inner wall of the outer member in a preloaded condition, the member further having an annular reaction pad arranged to act against the outer wall of the inner casing as the outer casing grows away from the inner casing whereby the inner casing is held in concentric alignment with the machine shaft during periods of growth.

BRIEF DESCRIPTION OF THE DRAWING

For a better understanding of the invention, as well as other objects and further features thereof, reference is had to the following detailed description of the invention to be read in connection with the accompanying drawing, wherein.

DESCRIPTION OF THE PREFERRED EMBODIMENT

Figure 2:
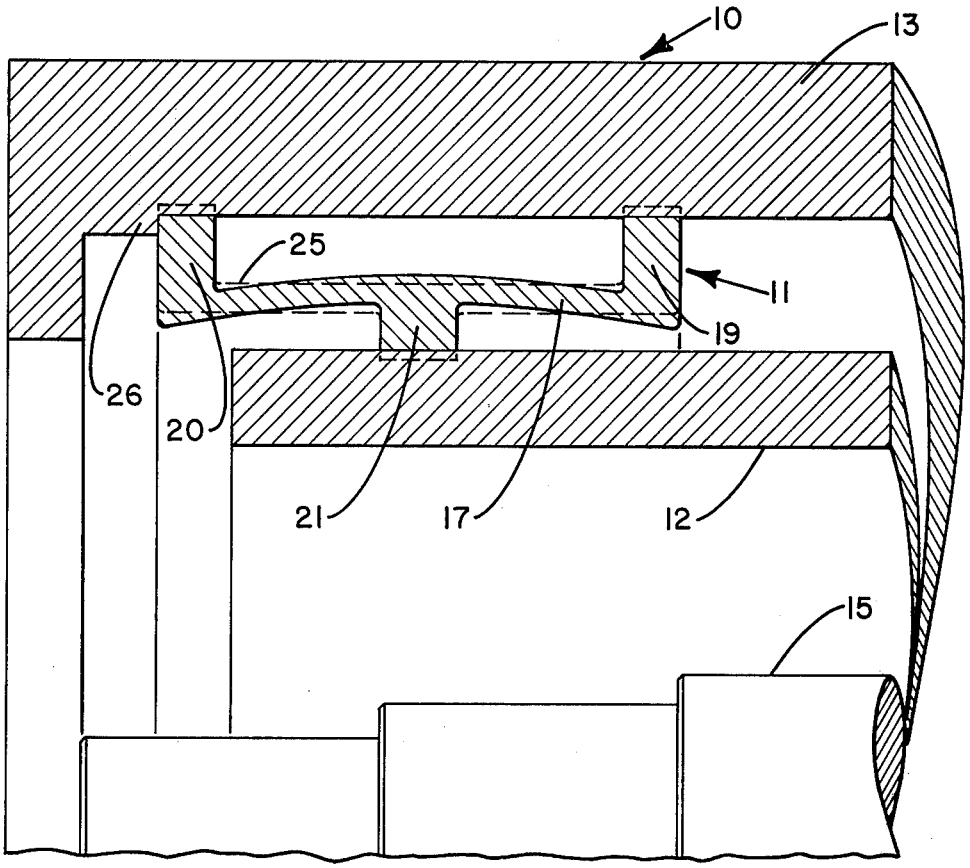
Figure 1:
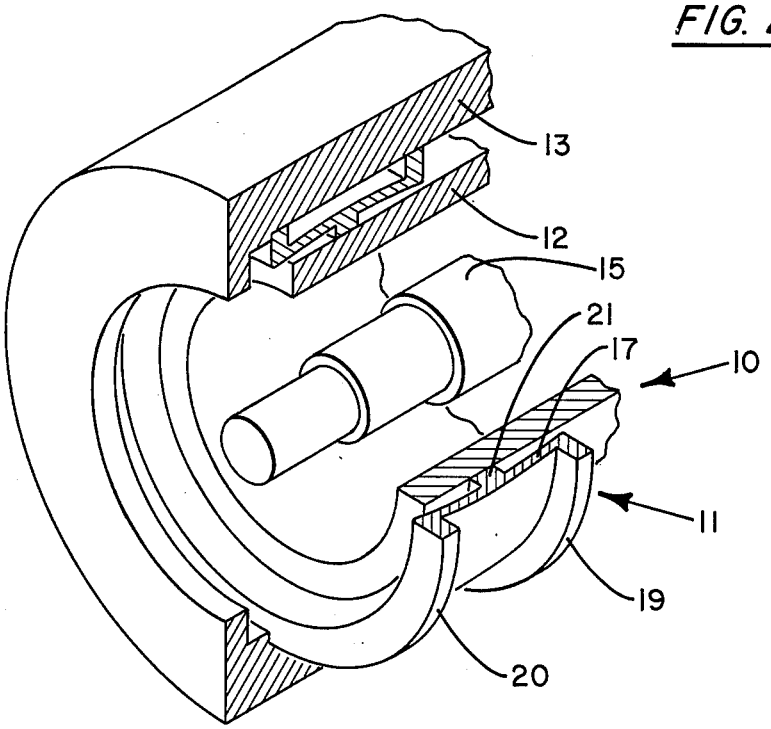
FIG. 1 is a perspective view in partial section showing the apparatus of the present invention; an FIG. 2 is a sectional side elevation of the apparatus shown in FIG. 1, further illustrating the construction of the annular member interposed between the inner and outer casings of the machine.

As illustrated in FIGS. 1 and 2, an annular member, generally referenced 11, is interposed between the inner casing 12 and the outer casing 13 of a rotary machine which, for explanatory purposes, will be referred to as a compressor 10. It should be understood, however, that the apparatus of the present invention can be utilized in any type of rotary device employing an inner casing mounted within an outer casing. Conventionally, in the two casing arrangement, the stationary machine components, such as diaphragms or the like, are suspended from the inner casing and are arranged to cooperate with the moving machine components which are supported on the rotor shaft. For the sake of clarity, these components are not shown on the present drawings. The machine shaft extends axially through the two casings and can be rotatably supported in the end wall of the machine or on pedestals located exterior to the machine. As can be seen, because the rotor shaft extends axially through the machine, the two superimposed casings cannot be centrally located along their common axis to hold them in alignment during periods of differential movement between the casing induced by transient thermal growth and/or pressure expansion. As will be explained below, the apparatus of the present invention has the ability to hold the inner casing in alignment with the machine shaft while, at the same time, permitting the outer casing to grow under high pressures and temperatures.

As seen in the drawings, the member 11 comprises a deformable annular beam 17 which is supported at each end upon annular mounting pads 19, 20. Centrally located upon the beam is a reaction ring 21. In assembly, the beam is mounted in axial alignment within the internal opening formed within the outer casing upon the two mounting pads. One pad, pad 20, is seated against a locating rib 26 carried by the outer casing which serves to locate the annular member 11 in assembly. The reaction ring 21 is arranged to extend inwardly in a radial direction toward the outer surface of the inner casing.

The annular member, because of its geometry, is adapted to function as a beam mounted upon an elastic foundation. In a normal or nondeformed condition, the annular member assumes a geometry similar to that described by the dotted line profile 25, seen in FIG. 2. The beam, when compressed, sets up a hyperbolic wave reaction whereby it attempts to return to a normal condition in a prescribed manner. The outside diameter of the nondeformed member, as defined by the outer periphery of the two mounting pads, is greater than the internal opening provided in the outer casing. In assembly, the annular member is compressed inward in a radial direction at pads 19 and 20 which causes pad 21 to expand outwardly away from the inner casing toward the outer casing some amount in opposition to the direction of applied force thus producing a deformation in the annular beam. The compressed annular member is then inserted within the outer casing and positioned against the locating rib. The force of compression is released, whereby the member tends to return to its normal unloaded condition. However, because the outer diameter of member 11 is greater than the internal wall diameter of the outer casing, the member is prevented from being unloaded. As a result, the support pads seat against the internal wall of the casing, holding the beam in a flexed or preloaded condition. This is best seen in FIG. 2. By design, the internal diameter of the centrally located reaction ring 21, when supported in the flexed or preloaded condition, is slightly greater than the outside diameter of the inner casing. As a result, the inner casing can be easily inserted therein and located in assembly in reference to the machine shaft.

As noted above, when the rotary machine is placed under high operating pressures and temperatures, the outer casing tends to grow away from the inner casing. As can be seen, as the space between the two bodies increases, the preloaded annular member, acting as a beam on a elastic foundation, begins to unflex in a predictable manner which brings the reaction ring into holding contact against the outer casing. A substantially uniform holding force is thus exerted about the inner casing which maintains the casing in concentric alignment with the rotor shaft. Under working stresses, as for example those governed by ASME Regulations, the beam is not permitted to return to its normal unstressed condition when maximum allowable stress is reached. As a consequence, a centering holding force is continually exerted by the member upon the inner casing over the entire operating range of the machine.

While this invention has been described with reference to the structure herein disclosed, it is not confined to the details as set forth, and this application is intended to cover any modifications or changes as may come within the scope of the following claims.

What is claimed is:

1. In a rotary machine having an inner casing coaxially aligned within an outer casing to provide an annular space therebetween, the space being pressurized under operating conditions whereby the adjacent walls of the two casings are moved apart due to thermal growth and pressure expansion, the improvement comprising a centering ring positioned within the annular space for supporting the two casings in coaxial alignment about a common axis as the casings move apart, the ring including an annular axial extending resilient beam coaxially aligned with the casings, two end members supporting the beam in a deflected condition therebetween whereby the end members are securely seated in holding contact against one of the adjacent casing walls, the beam being arranged to react uniformally when unloaded in a direction towards the other adjacent casing wall, and an annular reaction pad centrally located along the axial length of the beam on a side opposite to that upon which the beam is seated upon the end members and being arranged to move into holding contact against said other adjacent wall casing to deliver a uniform holding force thereupon to hold the two casings in centered alignment as they move away from each other during periods of thermal growth and pressure expansion.

2. The apparatus of claim 1 wherein the end members are seated in holding contact against the inner wall of the outer casing.

* * * * *